US009416699B2

(12) United States Patent
Hasegawa

(10) Patent No.: US 9,416,699 B2
(45) Date of Patent: Aug. 16, 2016

(54) HEATING DEVICE OF A PCV VALVE

(71) Applicant: KOJIMA INDUSTRIES CORPORATION, Toyota-shi, Aichi (JP)

(72) Inventor: Naohiro Hasegawa, Toyota (JP)

(73) Assignee: KOJIMA INDUSTRIES CORPORATION, Toyota-Shi (JP)

( * ) Notice: Subject to any disclaimer, the term of this patent is extended or adjusted under 35 U.S.C. 154(b) by 33 days.

(21) Appl. No.: 14/616,266

(22) Filed: Feb. 6, 2015

(65) Prior Publication Data

US 2015/0226097 A1 Aug. 13, 2015

(30) Foreign Application Priority Data

Feb. 10, 2014 (JP) ..... 2014-023354

(51) Int. Cl.
*F02B 25/06* (2006.01)
*F01M 13/00* (2006.01)
*F01M 13/04* (2006.01)

(52) U.S. Cl.
CPC ..... *F01M 13/0011* (2013.01); *F01M 13/00* (2013.01); *F01M 13/04* (2013.01); *F01M 2013/0027* (2013.01); *F01M 2013/0044* (2013.01)

(58) Field of Classification Search
CPC ... F01M 13/0011; F01M 13/00; F01M 13/04; F01M 2013/0044; F01M 2013/0027
USPC ..... 123/574
See application file for complete search history.

(56) References Cited

U.S. PATENT DOCUMENTS 4,205,642 A * 6/1980 Nishimura ..... F01M 13/023 123/143 C
4,768,493 A * 9/1988 Ohtaka ..... F01M 13/00 123/545
8,955,501 B2 * 2/2015 Tanikawa ..... F01M 13/023 123/574
2006/0236989 A1 * 10/2006 Callahan ..... F02M 25/06 123/574
2008/0245586 A1 * 10/2008 Sauvlet ..... F01M 5/001 180/65.275
2009/0229584 A1 * 9/2009 Asanuma ..... F02M 25/06 123/573
2013/0087128 A1 * 4/2013 Valencia ..... F01M 13/04 123/574
2013/0213370 A1 * 8/2013 Shirabe ..... F01M 5/002 123/574

FOREIGN PATENT DOCUMENTS

JP 2008215191 A 9/2008
JP 2009150351 A 7/2009

* cited by examiner

*Primary Examiner* — Marguerite McMahon
(74) *Attorney, Agent, or Firm* — Kenyon & Kenyon LLP

(57) ABSTRACT

A heating device of a PCV valve includes a PCV valve, a conduit and a bush. The PCV valve contacts the bush. The bush includes an outward protrusion. The outward protrusion includes a curved surface contacting an outside surface of the conduit in a manner of a surface-to-surface contact. Therefore, when the conduit is heated by engine cooling water, the bush contacting the conduit in the manner of a surface-to-surface contact is heated and the PCV valve contacting the bush is heated. Therefore, the PCV valve can be heated by the engine cooling water.

8 Claims, 5 Drawing Sheets

HEATING DEVICE OF A PCV VALVE

CROSS-REFERENCE TO RELATED APPLICATION

The present application claims priority to Japanese Patent Application No. 2014-023354 filed on Feb. 10, 2014, which is incorporated herein by reference in its entirety.

TECHNICAL FIELD

The present invention relates to a heating device for heating a positive crankcase ventilation (PCV) valve mounted to an oil separator made from resin.

BACKGROUND OF THE INVENTION

Blowby gas includes gas leaking from a clearance between a cylinder and a piston to a crankcase of an engine. Fuel economy is improved by leading the blowby gas to an intake passage. Further, since a pressure inside the crankcase can be made to a negative pressure, a pumping loss of a piston can be decreased. An engine oil mist is included in the blowby gas and the oil is separated from the blowby gas by an oil separator. The blowby gas from which the oil is separated is caused to flow to the intake passage. The amount of the blowby gas flowing to the intake passage is regulated by a PCV valve.

For decreasing manufacturing costs, the oil separator is made from resin. Therefore, when the PCV valve is mounted to the oil separator, a heat from the engine is more difficult to be transmitted to the PCV valve via the oil separator than in a case where the oil separator is made from metal. As a result, when an ambient temperature is low, a water component contained in the blowby gas may freeze whereby a blowby gas passage in the PCV valve may be blocked by ice.

Japanese Patent Publication 2009-150351 discloses that a portion of the oil separator to which the PCV valve is mounted is made from metal having a high coefficient of thermal conductivity so that the heat from the engine is efficiently transmitted to the PCV valve.

RELATED ART DOCUMENT

Patent Document

Patent Document 1: JP2009-150351

BRIEF SUMMARY

One object of the invention is to provide a heating device of a PCV valve which heats a PCV valve not by a heat transferred from an engine but by an engine cooling water (warmed water).

The present invention for achieving the above object is as follows:

(1) A heating device of a PCV valve comprises a PCV valve, a conduit and a bush each of which is made from metal.

The PCV valve is mounted to an oil separator made from resin via the bush.

The conduit includes an outside surface and an internal passage through which an engine cooling water flows.

The bush includes an inside surface, a portion of which contacts the PCV valve, and an outside surface, a first portion of which contacts the oil separator and a second portion of which contacts the outside surface of the conduit.

The bush includes an outward protrusion protruding outwardly in a radial direction of the bush and having a curved surface extending along the outside surface of the conduit in a circumferential direction of a cross section of the conduit so that the curved surface of the outward protrusion of the bush contacts a portion of the outside surface of the conduit, opposing the curved surface of the outward protrusion in a manner of a surface-to-surface contact, the curved surface of the outward protrusion defining the second portion of the outside surface of the bush.

(2) A heating device of a PCV valve according to item (1) above, wherein the bush and the conduit are welded to each other.

(3) A heating device of a PCV valve according to item (2) above, wherein the conduit includes a longitudinally bent portion extending along a portion of the outside surface of the bush in a circumferential direction of the bush and contacting the outside surface of the bush. The bush and the longitudinally bent portion of the conduit are welded to each other.

(4) A heating device of a PCV valve according to item (3) above, wherein the longitudinally bent portion extends by a half of a circumference of the bush.

(5) A heating device of a PCV valve according to item (3) above, the heating device of a PCV valve further comprises a cover made from resin. A portion of the bush and the longitudinally bent portion of the conduit are covered with the cover.

(6) A heating device of a PCV valve according to item (5) above, wherein the cover is fixed to the oil separator.

(7) A heating device of a PCV valve according to item (1) above, wherein the PCV valve includes a valve body including an outside surface. The inside surface of the bush contacts a portion of the outside surface of the valve body in a manner of a surface-to-surface contact.

(8) A heating device of a PCV valve according to item (1) above, wherein the oil separator includes a chamber, a gas inlet, an oil separating portion, a drain and a gas outlet. The gas inlet is provided so as to introduce blowby gas into the chamber. The oil separating portion is provided so as to separate oil from the blowby gas. The drain is provided so as to drain the oil separated from the blowby gas by the oil separating portion. The gas outlet is provided so as to cause the blowby gas from which the oil is separated by the oil separating portion to flow out from the chamber. The bush is pressed into the gas outlet.

Technical Advantages

According to the heating device of a PCV valve of items (1)-(8) above, the PCV valve contacts the bush. The bush includes the outward protrusion. The outward protrusion has the curved surface contacting the outside surface of the conduit in the manner of a surface-to-surface contact. Therefore, the following technical advantages can be obtained:

When the conduit is heated by an engine cooling water, the bush contacting the conduit in the manner of a surface-to-surface contact is heated and the PCV valve contacting the bush is heated. Therefore, the PCV valve can be heated by the engine cooling water. Since the bush contacts the conduit in the manner of a surface-to-surface contact, the bush is heated more efficiently than in a case where the bush does not contact the conduit in the manner of a surface-to-surface contact.

According to the heating device of a PCV valve of item (2) above, since the bush and the conduit are welded to each other, heat transfer from the conduit to the bush is conducted efficiently.

According to the heating device of a PCV valve of item (5) above, since the bush and the conduit are covered with the cover, radiation of heat from the bush and the conduit is more suppressed than in a case where the bush and the conduit are not covered with the cover.

DETAILED DESCRIPTION

A heating device of a PCV valve according to an embodiment of the present invention will be explained below with reference to the drawings.

Figure 1:
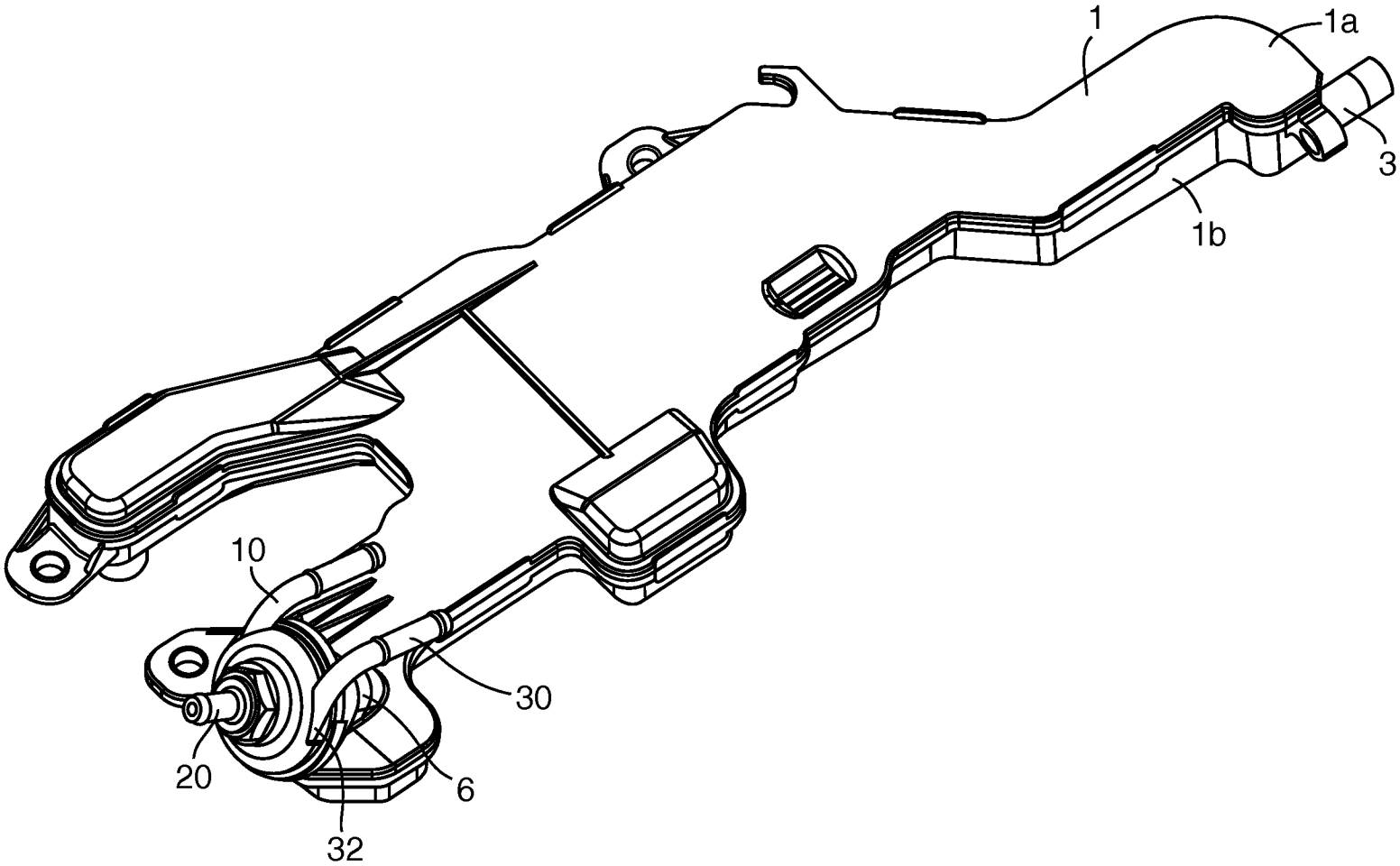
FIG. 1 is an oblique view of a heating device of a PCV valve according to the present invention.

As illustrated in FIG. 1, the heating device 10 of a PCV valve according to an embodiment of the present invention is a device heating a PCV valve 20 mounted to an oil separator 1 made from resin.

Figure 5:
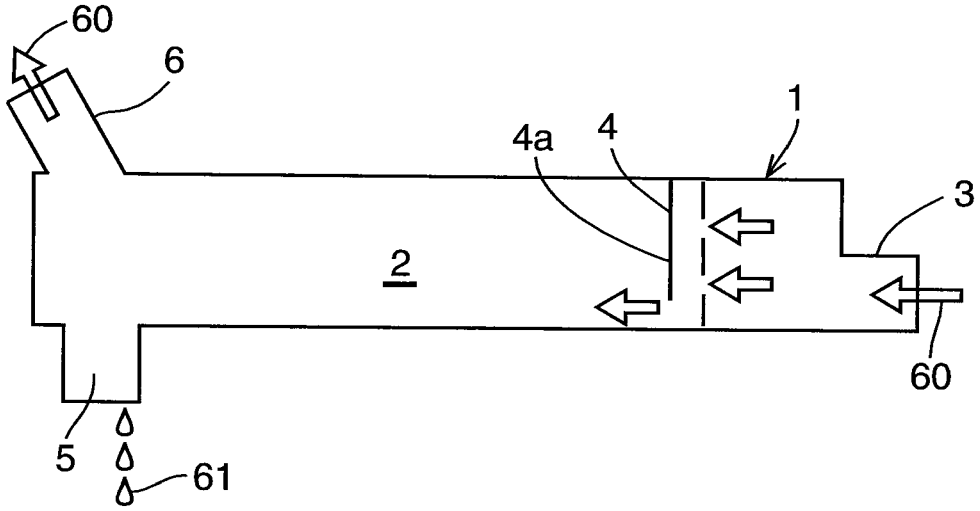
FIG. 5 is a schematic view of an oil separator to which the PCV valve of the heating device of a PCV valve according to the present invention is mounted.

As illustrated in FIG. 5, the oil separator 1 is provided so as to separate oil 61 from a blowby gas 60 leaking to a crankcase (not shown) of a vehicle engine (not shown). The oil 61 separated from the blowby gas is caused to flow to the crankcase. As illustrated in FIG. 1, the oil separator 1 includes an upper casing 1*a* and a lower casing 1*b*. The upper casing 1*a* and the lower casing 1*b* are manufactured separately from each other and fixed to each other. The upper casing 1*a* and the lower casing 1*b* are fixed to each other by vibration welding or an adhesive.

As illustrated in FIG. 5, the oil separator 1 includes a chamber 2, a gas inlet 3, an oil separating portion 4, a drain 5 and a gas outlet 6.

The chamber 2 is a space including an interior of the oil separator 1. The gas inlet 3 is provided so as to introduce the blowby gas 60 from an exterior of the oil separator 1 to the chamber 2. The oil separating portion 4 is provided so as to separate the oil 61 from the blowby gas 60. The drain 5 is provided so as to drain the oil 61 separated from the blowby gas 60 by the oil separating portion 4 to the exterior of the oil separator 1. The gas outlet 6 is provided so as to cause the blowby gas 60, from which the oil 61 is separated by the oil separating portion 4, to flow out from the chamber 2 to the exterior of the oil separator 1.

Figure 4:
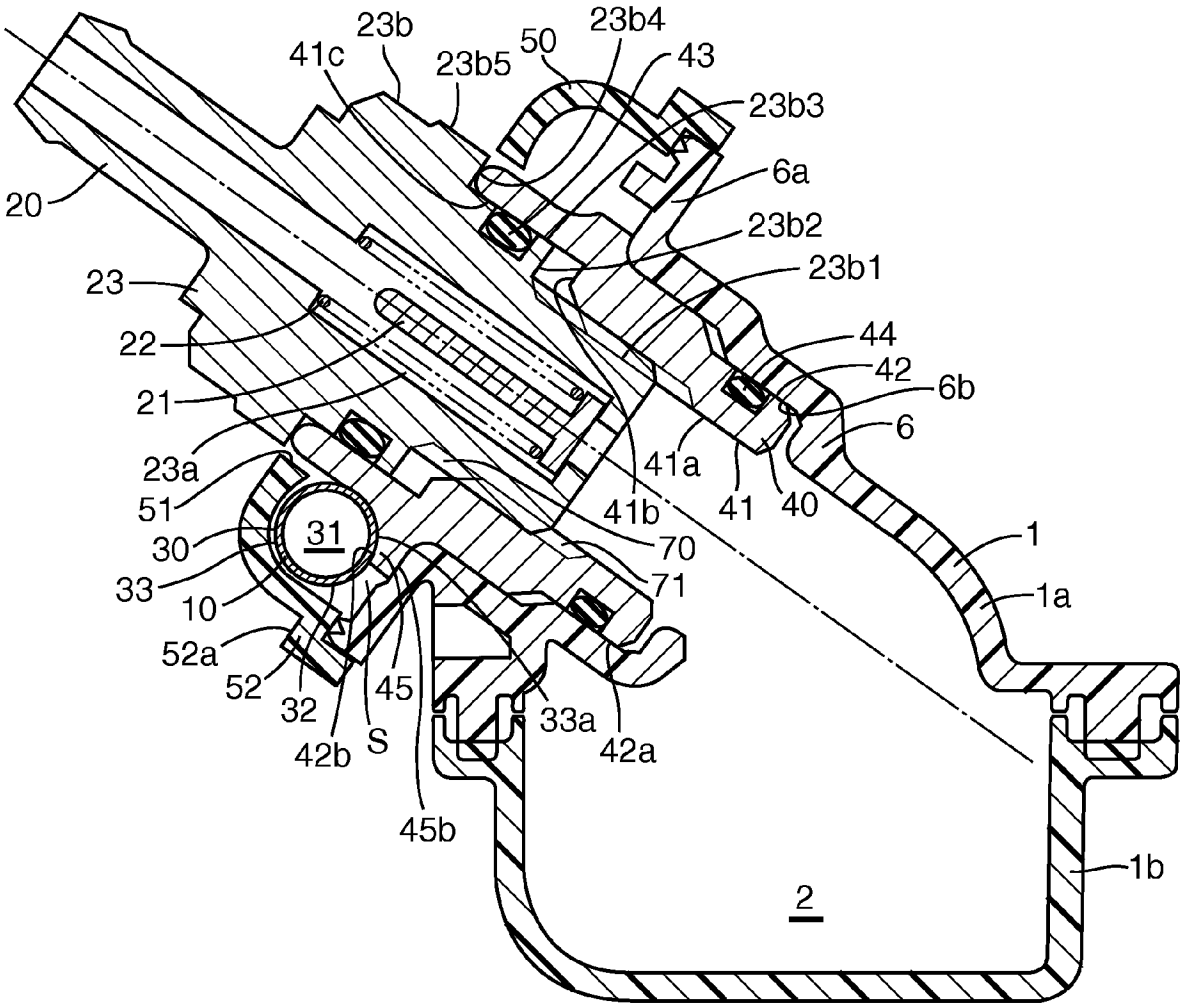
FIG. 4 is an enlarged cross-sectional view taken along line A-A of FIG. 2.

The single gas inlet 3, the single drain 5 and the single gas outlet 6 are provided one by one, respectively. The gas inlet 3 and the drain 5 are tubular and are provided at the lower casing 1*b*. The gas inlet 3 extends in a horizontal direction or a downward direction. The drain 5 extends in a downward direction. The gas outlet 6 is tubular and is provided at the upper casing 1*a*. The gas outlet 6 extends in an upward direction. As illustrated in FIG. 4, a flange 6*a* is formed at a downstream end portion of the gas outlet 6 in the blowby gas flow direction. The flange 6*a* is formed integral with the gas outlet 6. The flange 6*a* extends outwardly in a radial direction of the gas outlet 6.

The oil separator 1 may be (i) an inertia collision-type separator as shown in FIG. 5, (ii) a cyclone-type separator (not shown) or (iii) a labyrinth-type separator (not shown).

(i) When the oil separator 1 is an inertia collision-type separator, a baffle 4*a* to which the blowby gas 60 collides is provided and the oil 61 included in the blowby gas 60 adheres to the baffle 4*a* whereby the oil 61 is separated from the blowby gas 60.

(ii) When the oil separator 1 is a cyclone-type separator, the blowby gas 60 is caused to flow circularly and a centrifugal force is generated whereby the oil 61 is separated from the blowby gas 60.

(iii) When the oil separator 1 is a labyrinth-type separator, a partition (not shown) forming a portion of the interior of the chamber 2 into a labyrinth passage is provided whereby a flow passage of the blowby gas 60 in the chamber 2 is lengthened so that the oil 61 easily falls down by a self gravity of the oil 61 and so that a flow speed of the blowby gas 60 is caused to be higher and the oil 61 included in the blowby gas 60 easily contacts on a wall of the oil separator 1. As a result, the oil 61 is easily separated from the blowby gas 60.

As illustrated in FIG. 4, the heating device 10 of a PCV valve includes the PCV valve 20, a conduit (a pipe) 30 having an outside surface 33, a bush 40 and a cover 50.

The PCV valve 20 is provided so as to regulate the amount of the blowby gas flowing from the chamber 2 to the exterior of the oil separator 1. The PCV valve 20 is made from metal, and the metal is, for example, iron, steel, copper or aluminum. As illustrated in FIG. 4, the PCV valve 20 includes a plunger (a movable valve element) 21, a spring 22 and a valve body 23. The plunger 21 moves relative to the valve body 23 whereby a cross-sectional area of an internal passage 23*a* of the valve body 23 is changed. Therefore, the amount of the blowby gas flowing through the internal passage of the PCV valve 20 is controlled by the PCV valve 20.

The valve body 23 is made from metal, and the metal is, for example, iron, steel, copper or aluminum. The valve body 23 includes an outside surface 23*b*. The outside surface 23*b* of the valve body 23 includes a small-diameter portion 23*b*1, a large-diameter portion 23*b*3 and a second large-diameter portion 23*b*5. The large-diameter portion 23*b*3 is located downstream of the small-diameter portion 23*b*1 in a blowby gas flow direction. The large-diameter portion 23*b*3 and the small-diameter portion 23*b*1 are connected via a step 23*b*2. A diameter of the large-diameter portion 23*b*3 is larger than a diameter of the small-diameter portion 23*b*1. The second large-diameter portion 23*b*5 is located downstream of the large-diameter portion 23*b*3 in the blowby gas flow direction. The second large-diameter portion 23*b*5 and the large-diameter portion 23*b*3 are connected via a second step 23*b*4. A diameter of the second large-diameter portion 23*b*5 is larger than the diameter of the large-diameter portion 23*b*3.

The valve body 23 is mounted to the gas outlet 6 of the oil separator 1 via the bush 40 contacting the valve body 23.

The bush 40 is made from metal, and the metal is, for example, iron, steel, copper or aluminum. The bush 40 is pressed into the gas outlet 6. The bush 40 is tubular. The bush 40 includes an inside surface 41 and an outside surface 42.

A portion of the inside surface 41 of the bush 40 contacts the PCV valve 20. The inside surface 41 of the bush 40 includes a small-diameter portion 41*a* and a large-diameter portion 41*c*. The large-diameter portion 41*c* is located downstream of the small-diameter portion 41*a* in the blowby gas flow direction. The large-diameter portion 41*c* and the small-diameter portion 41*a* are connected via a step 41*b*. A diameter of the large-diameter portion 41*c* is larger than a diameter of the small-diameter portion 41*a*.

A male screw 70 is formed at the small-diameter portion 23*b*1 of the outside surface 23*b* of the valve body 23. A female screw 71 is formed at the small-diameter portion 41*a* of the inside surface 41 of the bush 40. The male screw 70 is threaded into the female screw 71 whereby the valve body 23 (PCV valve 20) is coupled to the small-diameter portion 41*a* of the inside surface 41 of the bush 40. The step 41*b* of the bush 40 axially opposes the step 23*b*2 of the valve body 23. The large-diameter portion 41*c* of the inside surface 41 of the bush 40 contacts the large-diameter portion 23*b*3 of the outside surface 23*b* of the valve body 23 in a manner of a surface-to-surface contact. The surface-to-surface contact between the large-diameter portion 23*b*3 of the outside surface 23*b* of the valve body 23 and the large-diameter portion 41*c* of the inside surface 41 of the bush 40 is sealed by an O-ring 43. A thickness of the bush 40 at the large-diameter portion 41*c* of the inside surface 41 is substantially equal to a step amount of the second step 23*b*4 of the valve body 23.

The outside surface 42 of the bush 40 includes a first portion 42*a* and a second portion 42*b* axially separate from the first portion 42*a*. The first portion 42*a* of the outside surface 42 contacts an inside surface 6*b* of the gas outlet 6 of the oil separator 1 in a manner of a surface-to-surface contact. The second portion 42*b* of the outside surface 42 contacts the outside surface 33 of the conduit 30 in a manner of a surface-to-surface contact. The surface-to-surface contact between the outside surface 42 of the bush 40 and the inside surface 6*b* of the gas outlet 6 of the oil separator 1 is sealed by an O-ring 44.

The bush includes an outward protrusion 45. The outward protrusion 45 is formed integral with the bush 40. The outward protrusion 45 is formed at an intermediate portion of the bush 40 in an axial direction of the bush (i.e., in the blowby gas flow direction). The outward protrusion 45 protrudes outwardly in a radial direction of the bush 40. The outward protrusion 45 radially outwardly protrudes to a space S formed axially between the conduit 30 and the flange 6*a* of the gas outlet 6. The outward protrusion 45 has a curved surface extending along the outside surface 33 of the conduit 30 in a circumferential direction of a cross section of the conduit 30, and the curved surface defines the second portion 42*b* of the outside surface 42 of the bush 40. The curved surface (i.e., the second portion 42*b* of the outside surface 42 of the bush 40) 42*b* contacts a portion 33*a* of the outside surface 33 of the conduit 30, opposing the curved surface 42*b* in a manner of a surface-to-surface contact. A surface 45*b* of the outward protrusion 45 axially opposing the flange 6*a* of the gas outlet 6 contacts a portion of the flange 6*a* opposing the surface 45*b* in a manner of a surface-to-surface contact. Since the bush 40 includes the outward protrusion 45 and the outward protrusion 45 includes the curved surface 42*b*, the bush 40 contacts the outside surface 33 of the conduit 30 at the portion 33*a* in a manner of a surface-to-surface contact.

Figure 2:
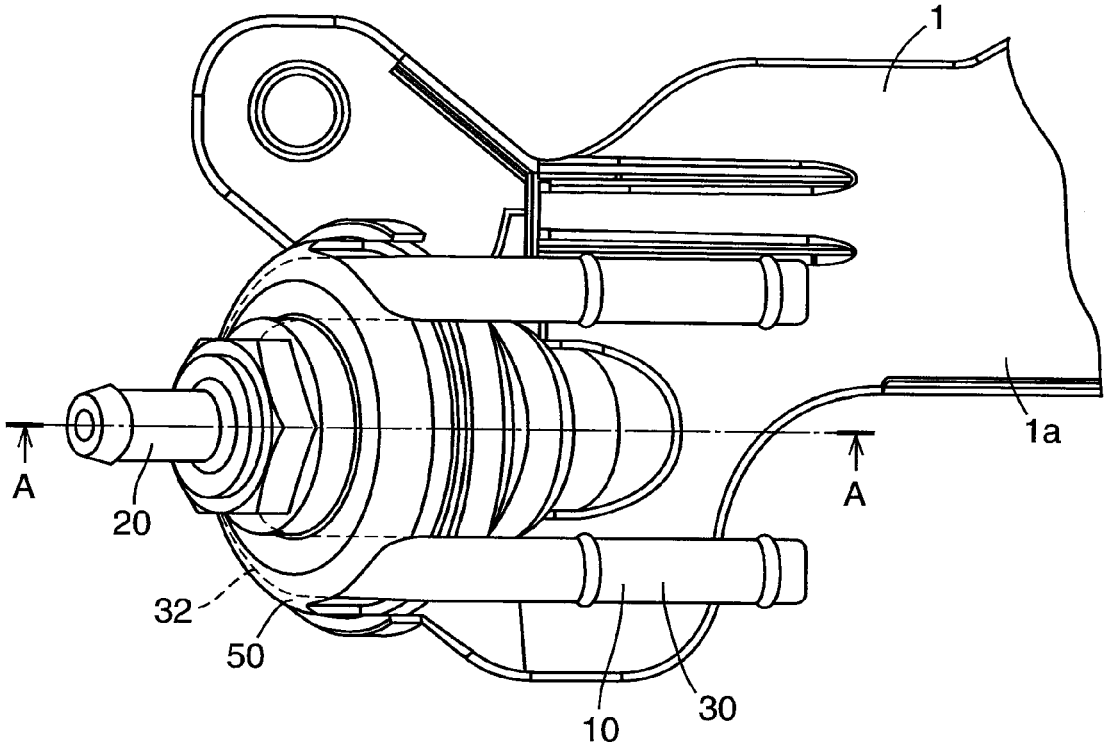
FIG. 2 is an enlarged plane view of the PCV valve and its vicinity of the heating device of a PCV valve according to the present invention.
Figure 3:
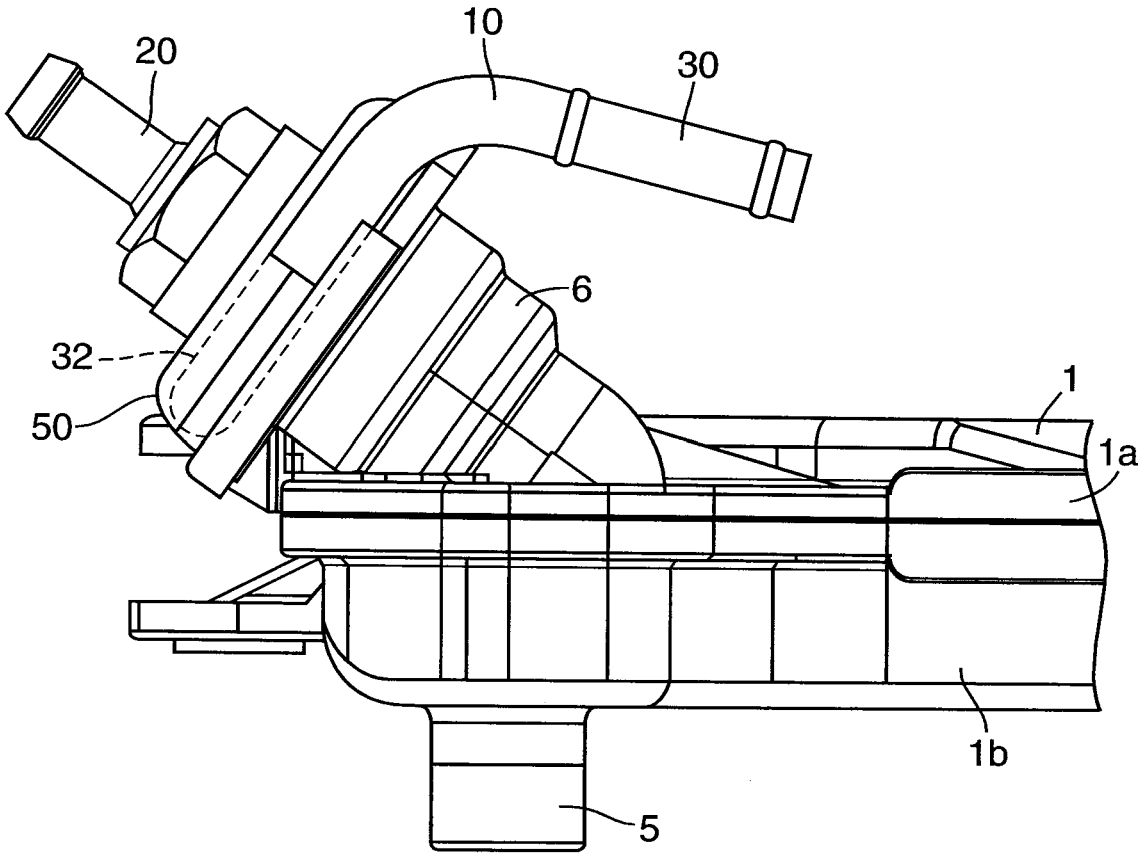
FIG. 3 is an enlarged side view of the PCV valve and its vicinity of the heating device of a PCV valve according to the present invention.

The conduit 30 includes an internal passage 31. An engine cooling water (not shown, warmed water) for cooling the engine (not shown) flows through the internal passage 31. The conduit 30 is made from metal, and the metal is, for example, iron, stainless-steel, copper or aluminum. As illustrated in FIG. 2, the conduit 30 includes a longitudinally bent portion 32 extending along a portion of the outside surface 42 of the bush 40 in a circumferential direction of the bush 40. The longitudinally bent portion 32 extends by a half of a circumference of the bush 40. As illustrated in FIG. 4, the longitudinally bent portion 32 is located outside the oil separator 1. The longitudinally bent portion 32 contacts the outside surface 42 of the bush 40. The amount of heat transfer from the conduit 30 to the bush 40 is proportional to a size of the contact area of the conduit 30 and the bush 40. Since the longitudinally bent portion 32 extends by a half of the circumference of the bush 40, the size of the contact area of the conduit 30 and the bush 40 is kept large.

The longitudinally bent portion 32 of the conduit 30 and the bush 40 may be welded to each other. In order to weld the conduit 30 and the bush 40 to a deep position of the coupling of the conduit 30 with the bush 40, it is desirable that the weld of the conduit 30 and the bush 40 is conducted by brazing. According to brazing, a size of the contact area between the conduit 30 and the bush 40 can be large. However, the weld the conduit 30 and the bush 40 may be conducted by TIG welding or laser beam welding.

At least a portion of the longitudinally bent portion 32 of the conduit 30 not covered with the gas outlet 6 (located outside the gas outlet 6) and at least a portion of the bush 40 not covered with the gas outlet 6 (located outside the gas outlet 6) are covered with the cover 50 made from resin. Therefore, radiation of heat from the longitudinally bent portion 32 and the bush 40 can be suppressed by the cover 50.

The cover 50 is located outside the oil separator 1. The cover 50 is located outside the bush 40 in the radial direction of the bush. An inner end surface 51 of the cover 50 radially opposes the outside surface 42 of the bush 40. The inner end surface 51 of the cover 50 opposes a downstream end portion of the outside surface 42 of the bush 40. The cover 50 extends outwardly in the radial direction of the bush 40 from the inner end surface 51. A portion of the cover 50 extends along the outside surface 33 of the conduit 30 in the circumferential direction of the cross section of the conduit 30. A step 52*a* is formed at an outside surface of a radially outer end portion 52 of the cover 50. The radially outer end portion 52 of the cover 50 is fixed to the flange 6*a* of the gas outlet 6.

The cover 50 is fixed to the flange 6*a* of the gas outlet 6 by ultrasonic bonding or an adhesive. The cover 50 may or may not contact the longitudinally bent portion 32 of the conduit 30. The inner end surface 51 of the cover 50 may or may not contact the outside surface 42 of the bush 40.

Next, operation and technical advantages of the embodiment of the present invention will be explained.

The PCV valve 20 contacts the bush 40. The bush 40 includes the outward protrusion 45. The outward protrusion 45 has the curved surface 42*b* contacting the outside surface 33 of the conduit 30 in the manner of a surface-to-surface contact. Therefore, the following technical advantages are obtained:

When the conduit 30 is heated by the engine cooling water, the bush 40 contacting the conduit 30 in the manner of a surface-to-surface contact is heated and the PCV valve 20 contacting the bush 40 is heated. Therefore, the PCV valve 20 can be heated by the engine cooling water.

Since the bush 40 contacts the conduit 30 in the manner of a surface-to-surface contact, the bush 40 is heated more efficiently than in a case where the bush 40 does not contact the conduit 30 in the manner of a surface-to-surface contact.

Since the PCV valve 20 contacts the bush 40 in the manner of a surface-to-surface contact, the PCV valve 20 is heated more efficiently than in a case where the PCV valve 20 does not contact the bush 40 in the manner of a surface-to-surface contact.

Since the bush 40 and the conduit 30 are welded to each other, heat transfer from the conduit 30 to the bush 40 is conducted efficiently.

Since the bush 40 and the conduit 30 are covered with the cover 50, escape of heat due to radiation from the bush 40 and the conduit 30 is more suppressed than in a case where the bush 40 and the conduit 30 are not covered with the cover 50.

Since the cover 50 is fixed to the oil separator 1, the bush 40 pressed into the gas outlet 6 of the oil separator 1 is suppressed from dropping off from the oil separator 1.

The longitudinally bent portion 32 of the conduit 30 not covered with the gas outlet 6 (located outside the gas outlet 6) and the bush 40 not covered with the gas outlet 6 (located outside the gas outlet 6) are covered with the cover 50 made from resin. Therefore, heat transfer from the conduit 30 to the PCV valve 20 via the bush 40 can be completely (including substantially completely) conducted inside the resin members (gas outlet 6 and the cover 50) having a high-insulating ability as a heat insulator. As a result, heat transfer from the conduit 30 to the PCV valve 20 is conducted efficiently.

EXPLANATION OF REFERENCE NUMERALS

1 oil separator
1*a* upper casing
1*b* lower casing
2 chamber
3 gas inlet
4 oil separating portion
4*a* baffle
5 drain
6 gas outlet
6*a* flange
10 heating device of a PCV valve
20 PCV valve
21 plunger
22 spring
23 valve body
23*a* internal passage of the valve body
23*b* outside surface of the valve body
30 conduit
31 internal passage of the conduit
32 longitudinally bent portion
33 outside surface of the conduit
40 bush
41 inside surface of the bush
42 outside surface of the bush
42*a* first portion
42*b* second portion
43,44 O-ring
45 outward protrusion
50 cover
60 blowby gas
61 oil

What is claimed is:

1. A heating device of a PCV valve comprising: a PCV valve, a conduit and a bush each of which is made from metal, wherein the PCV valve is mounted to an oil separator made from resin via the bush, wherein the conduit includes an outside surface and an internal passage through which an engine cooling water flows, wherein the bush includes an inside surface, a portion of which contacts the PCV valve, and an outside surface, a first portion of which contacts the oil separator and a second portion of which contacts the outside surface of the conduit, and wherein the bush includes an outward protrusion protruding outwardly in a radial direction of the bush and having a curved surface extending along the outside surface of the conduit in a circumferential direction of a cross section of the conduit so that the curved surface of the outward protrusion of the bush contacts a portion of the outside surface of the conduit, opposing the curved surface of the outward protrusion in a manner of a surface-to-surface contact, the curved surface of the outward protrusion defining the second portion of the outside surface of the bush.

2. A heating device of a PCV valve according to claim 1, wherein the bush and the conduit are welded to each other.

3. A heating device of a PCV valve according to claim 2, wherein the conduit includes a longitudinally bent portion extending along a portion of the outside surface of the bush in a circumferential direction of the bush and contacting the outside surface of the bush, and wherein the bush and the longitudinally bent portion of the conduit are welded to each other.

4. A heating device of a PCV valve according to claim 3, wherein the longitudinally bent portion extends by a half of a circumference of the bush.

5. A heating device of a PCV valve according to claim 3, further comprising a cover made from resin, wherein a portion of the bush and the longitudinally bent portion of the conduit are covered with the cover.

6. A heating device of a PCV valve according to claim 5, wherein the cover is fixed to the oil separator.

7. A heating device of a PCV valve according to claim 1, wherein the PCV valve includes a valve body including an outside surface, and wherein the inside surface of the bush contacts a portion of the outside surface of the valve body in a manner of a surface-to-surface contact.

8. A heating device of a PCV valve according to claim 1, wherein the oil separator includes a chamber, a gas inlet, an oil separating portion, a drain and a gas outlet, wherein the gas inlet is provided so as to introduce blowby gas into the chamber, wherein the oil separating portion is provided so as to separate oil from the blowby gas, wherein the drain is provided so as to drain the oil separated from the blowby gas by the oil separating portion, wherein the gas outlet is provided so as to cause the blowby gas from which the oil is separated by the oil separating portion to flow out from the chamber, and wherein the bush is pressed into the gas outlet.

* * * * *